US006241333B1

(12) United States Patent
Wen

(10) Patent No.: US 6,241,333 B1
(45) Date of Patent: Jun. 5, 2001

(54) INK JET PRINTHEAD FOR MULTI-LEVEL PRINTING

(75) Inventor: Xin Wen, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/783,256

(22) Filed: Jan. 14, 1997

(51) Int. Cl.[7] ..... B41J 2/205; B41J 2/14; B41J 29/38

(52) U.S. Cl. ..... 347/15; 347/48; 347/9

(58) Field of Search ..... 347/15, 48

(56) References Cited

U.S. PATENT DOCUMENTS

| | | | | |
|---|---|---|---|---|
| 3,790,703 | * | 2/1974 | Carley | 347/48 X |
| 4,251,824 | * | 2/1981 | Hara | 347/15 X |
| 4,314,263 | * | 2/1982 | Carley | 347/48 |
| 4,340,896 | * | 7/1982 | Cruz-Uribe | 347/85 |
| 4,463,359 | * | 7/1984 | Ayata | 347/60 X |
| 4,550,324 | * | 10/1985 | Tamaru | 346/140.1 X |
| 4,723,129 | * | 2/1988 | Endo | 347/56 |
| 5,121,143 | * | 6/1992 | Hayamizu | 347/15 X |
| 5,550,568 | * | 8/1996 | Misumi | 347/12 |
| 5,650,803 | * | 7/1997 | Tamura | 347/15 |
| 5,745,128 | * | 4/1998 | Lam | 346/140.1 |
| 5,880,759 | * | 3/1999 | Silverbrook | 347/48 X |

FOREIGN PATENT DOCUMENTS

| | | | | |
|---|---|---|---|---|
| 613 781 | * | 9/1994 | (EP) | B41J/2/205 |
| 0779159 A2 | | 6/1997 | (EP) | B41J/2/21 |
| 62-77945 | * | 4/1987 | (JP) | B41J/3/04 |
| 63-295270 | * | 12/1988 | (JP) | B41J/3/04 |
| 5-169678 | * | 7/1993 | (JP) | B41J/2/175 |
| 6-91893 | * | 4/1994 | (JP) | B41J/2/175 |
| 6-255110 | * | 9/1994 | (JP) | B41J/2/05 |

* cited by examiner

*Primary Examiner*—John Barlow
*Assistant Examiner*—An H. Do
(74) *Attorney, Agent, or Firm*—Walter S. Stevens

(57) ABSTRACT

In accordance with a feature of the present invention, an ink jet printing assembly includes a plurality of nozzles having a respective ink-ejection opening arranged to form at least one nozzle group. The ink-ejection opening of each of the nozzles that form a nozzle group has a size essentially equal to a corresponding size of the ink-ejection openings of all other nozzles of the group. Each of the nozzles of a group are respectively adapted to produce a different print density when actuated by an input signal.

21 Claims, 5 Drawing Sheets

INK JET PRINTHEAD FOR MULTI-LEVEL PRINTING

CROSS-REFERENCE TO RELATED APPLICATIONS

Reference is made to commonly assigned, co-pending U.S. Pat. No. 5,880,759 filed in the name of K. Silverbrook and corresponding to PCT/US96/04887 filed Apr. 9, 1996 now U.S. Pat. No. 5,880,759.

BACKGROUND OF THE INVENTION

1. Technical Field

This invention relates generally to ink jet printing, and more specifically to multi-density printing by ink jet printheads.

2. Background Art

Commonly assigned, co-pending U.S. Pat. No. 5,880,759 filed in the name of K. Silverbrook and corresponding to PCT/US96/04887 filed Apr. 9, 1996, discloses a liquid printing system that affords significant improvements toward overcoming the prior art problems associated with drop size and placement accuracy, attainable printing speeds, power usage, durability, thermal stresses, other printer performance characteristics, manufacturability, and characteristics of useful inks. FIG. 1 shows a single microscopic nozzle tip according to the Silverbrook disclosure. Pressurized ink 100 extends from the nozzle, which is formed from silicon dioxide layers 102 with a heater 103 and a nozzle tip 104. The nozzle tip is passivated with silicon nitride. The "Silverbrook" technique provides for low power consumption, high speed, and page-wide printing. In such ink jet printheads, the energy barrier for ejecting an ink droplet is reduced by reducing the surface tension of the ink solution. Referring to FIGS. 2*a*–2*d*, the ink solution in an ink reservoir is under a static pressure so that a ink meniscus is bulged outward at a nozzle outlet (FIG. 2*a*). For each selected nozzle, a voltage pulse is applied to a ring-shaped resistor. The heating of the resistor by the electric pulse reduces the surface tension of the ink solution in the vicinity of the rim of the nozzle. The heated ink solution is pushed outward by the static pressure (FIG. 2*b*). The interplay between the surface tension reduction by heating and the static pressure begins to dominate (FIG. 2*c*), and finally ejects the ink droplet to a receiver media (FIG. 2*d*). The separation of the droplet from the nozzle can be assisted by a static electric field applied that attracts the ink droplet toward the receiving media.

For many digital printing applications, it is most desired to print in more than two density levels. The present invention provides a printhead architecture that is capable of printing multiple density levels (more than 1 bit) per pixel using the Silvebrook printing technique.

Several methods of printing multiple density levels have been disclosed in the prior art. U.S. Pat. No. 4,353,079 disclosed a thermal ink jet recording apparatus in which a single nozzle is capable of printing multiple droplet sizes. Difficulties occur in this technique when more than one droplet is needed to achieve certain density levels. The print head needs either to stop at a pixel location so that all droplets of different size intended for that pixel are printed before moving to the next pixel, or the different droplets intended for each pixel need to be deflected to the same pixel location while the print head is moving relative to the media. The former approach significantly would decrease printing speed, and the latter is extremely difficult to achieve.

U.S. Pat. No. 4,746,935 and U.S. Pat. No. 5,412,410 disclose ink jet printheads that include multiple nozzles of different diameters. The different diameters lead to ink droplets different in volumes, resulting in multiple density levels on the receiver medium. This technique has practical difficulty in achieving a wide enough dynamic range in the nozzle diameters. At high resolution digital printing, it is required that the biggest droplet be small in volume so that a single droplet is compatible with the pixel size. On the other hand, the minimum nozzle diameter is also restricted by the ink fluid dynamics within the nozzle. When the ink is pushed outward in a ejection, the ink fluid needs to overcome a significant resistance caused by the static nozzle front plate and the ink channel surface. This resistive interaction is most active within a decay length of the physical boundary, that depends on the ejection kinetics as well as the properties of the ink and the nozzle. The nozzle diameter is required to be significantly larger than twice the above decay length to allow a free channel for the ink flow. The combination of the two requirements limits the dynamic range of the print density in the prior art technique. Secondly, for the Silverbrook-type ink jet printhead, the limitation on the dynamic range would be even more stringent. The Silverbrook technique uses back pressure to form a bulged meniscus at the nozzle exit. When the nozzle diameter is large, the ink will flow out across the surface of the front plate. In addition, since Silverbrook does not have additional mechanical driving force on selected ink (other than the static back pressure), the ejection speed of the droplet is very strongly dependent on the dragging force from the physical boundaries of the nozzle. The nozzle diameter must be above a value that is higher than the "no-flow" limit as described above so that the speed benefit of page-wide printing is not lost to decreased firing rate per line. Finally, manufacture variabilities in nozzle diameters are relatively larger for smaller nozzles. For Silverbrook printheads, for example, these variabilities affect the meniscus shape of the ink fluid at the nozzle exit, which in turn affect droplet volume and ejection rate.

DISCLOSURE OF THE INVENTION

It is an object of the present invention to provide techniques for multi-density printing by ink jet printheads having nozzles of essentially the same diameter.

In accordance with a feature of the present invention, an ink jet printing assembly includes a plurality of nozzles having a respective ink-ejection opening arranged to form at least one nozzle group. The ink-ejection opening of each of the nozzles that form a nozzle group has a size essentially equal to a corresponding size of the ink-ejection openings of all other nozzles of the group. Each of the nozzles of a group are respectively adapted to produce a different print density when actuated by an input signal.

According to preferred embodiments of the present invention, each of the nozzles of a group are respectively adapted to produce a different print density by ejecting a different amount of ink when actuated, by ejecting inks of respectively different densities when actuated, or by ejecting a respectively different number of ink droplets when actuated. All of the plurality of nozzles of a group may be aligned in a direction to produce pixels at the same location on a receiver that is moving in said direction relative to the printing assembly, or in a direction to produce pixels at different locations on a receiver that is moving in other than said direction relative to the printing assembly.

According to other features of preferred embodiments of the present invention, each of the nozzles of a group are respectively adapted to produce a different print density when actuated by substantially identical input signals. The nozzles may eject an amount of ink that is proportional to an amount of electrical energy that is applied thereto, whether in the form of a different electrical voltage for each nozzle of a group, an electrical pulse of different duration for each nozzle of a group, or other.

According to still other features of preferred embodiments of the present invention, each of the nozzles of a group are respectively adapted to produce a different print density when a different ink pressure is applied to each nozzle of a group.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
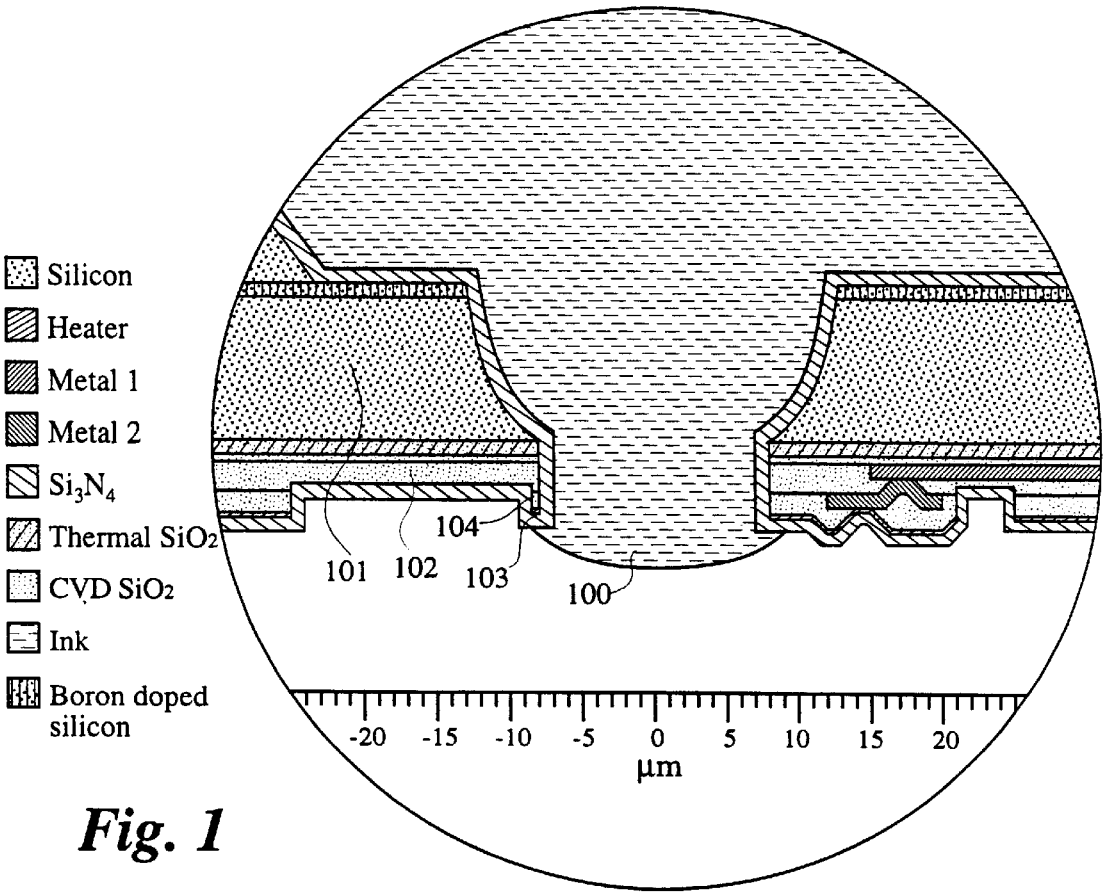
FIG. 1 is a cross sectional view of a nozzle tip according to a prior invention and usable in the present invention.
Figure 2A:
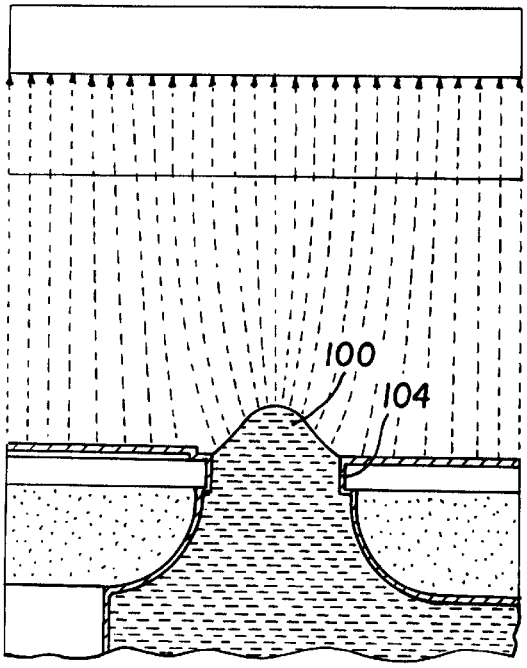
FIGS. 2*a*–2*d* are a series of views of ink being ejected from the nozzle tip of FIG. 1.
Figure 2B:
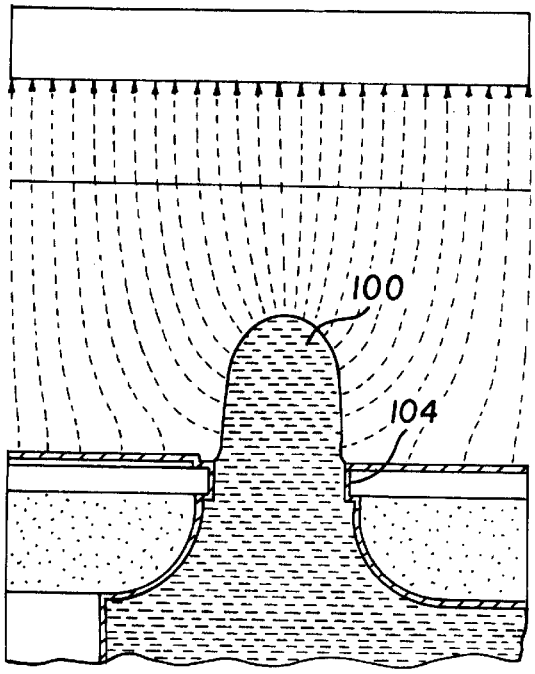
Figure 2C:
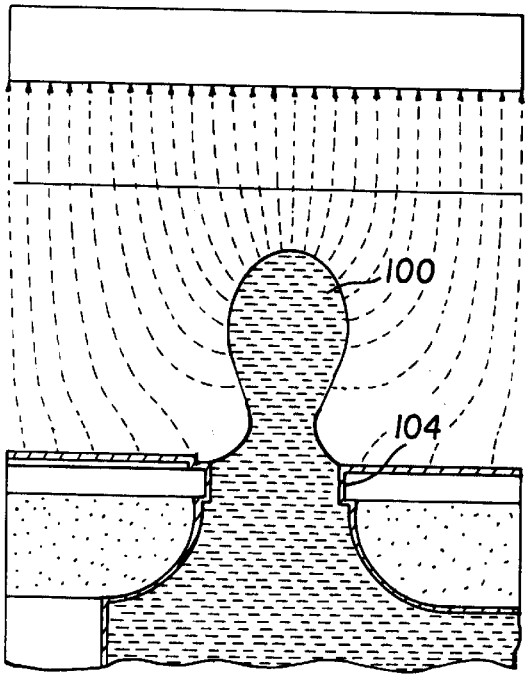
Figure 2D:
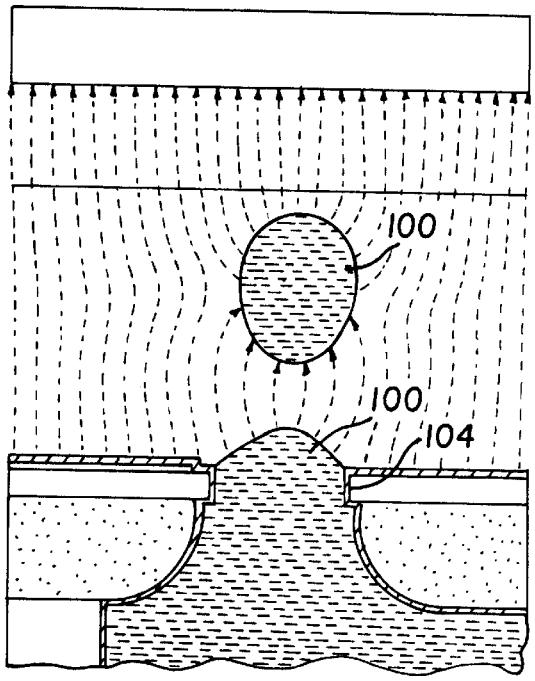
Figure 3:
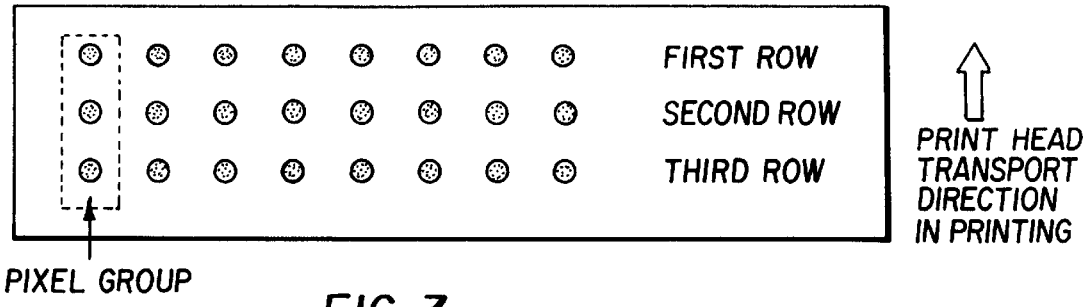
FIG. 3 is a plan view of an ink jet printhead according to the present invention.
Figure 4:
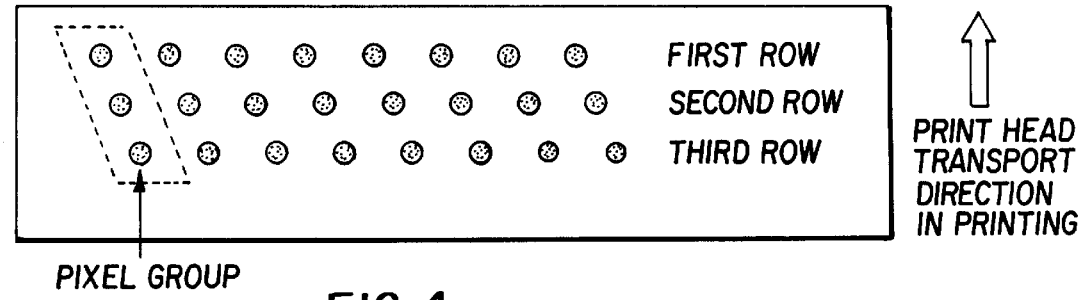
FIG. 4 is a plan view of another ink jet printhead according to the present invention.
Figure 5:
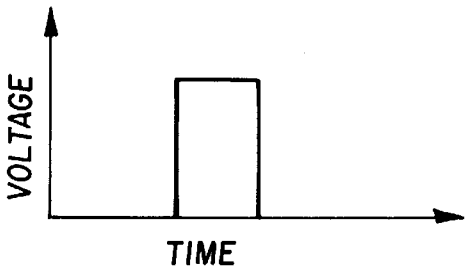
FIG. 5 illustrates a constant voltage pulse at a fixed pulse applied to the heating resistor of the nozzle tip of FIG. 1 for lowering the ink surface tension.
Figure 6:
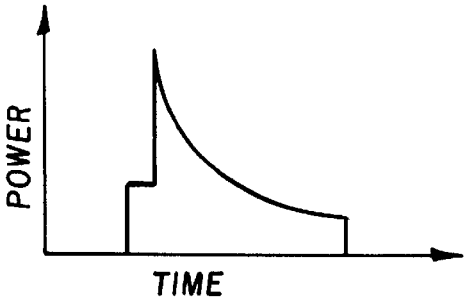
FIG. 6 illustrates a varied voltage pulse at a fixed pulse applied to the heating resistor of the nozzle tip of FIG. 1 for lowering the ink surface tension.

FIGS. 3 and 4 illustrate the physical arrangement of ink jet nozzles according to two embodiments of the present invention. In each embodiment, printing nozzles are arranged in a plurality of rows, three rows of nozzles being illustrated. Aligned nozzles in the three rows of FIG. 5, and staggered nozzles of FIG. 6, are considered for purposes of this disclosure to be in the same "group." A controller, which is connected to the nozzles, produces a series of input signals that are ultimately supplied to the nozzles.

The physical parameters of nozzles in different rows are essentially kept the same. During printing, the nozzles that are in the same group, but in different rows, eject ink droplets to the same pixel location on receiving media. Any on-off combinations can be applied to the nozzles within each group to obtain multiple density levels.

The volume of the ejected ink droplet in a Silverbrook-type print head is dependent on several parameters, such as for example the degree of heating, the back pressure applied to the ink fluid, the strength of the electrostatic field for the droplet separation, and the nozzle size. For a fixed ink density, larger droplet volumes lead to higher print densities on the receiver media.

In a first embodiment of the present invention, different nozzles in a pixel group are fabricated with heating resistive elements of different resistance values. Since the heating power is inversely proportional to resistance, the variation in resistance increases the dynamic range for the variation of the heat energy in each pixel group. In the simplest case, the same electric heating pulses are applied to all the nozzles, and a density degradation is achieved by the differences in the resistance values between the nozzles in each pixel group.

The previously mentioned controller sends an electric pulse is sent to selected nozzles to elevate the ink-surface temperature and to lower the surface tension. This eases the movement of the ink and causes the formation of an ink droplet. The electric pulses can be constant in voltage, as shown in FIG. 5, which is convenient for digital electronic control. The heating pulse can also be in analog forms. For example, the electric pulse in FIG. 6 consists of a low-power preheat stage to uniformly warm up the ink solution, and a high and a non-linear decaying profile to avoid excessive heating. This is useful because the ink solution should be kept below the boiling temperature so that the nozzles will not be blocked by coalescence of bubbles.

The dynamic range of print density may be further increased by applying different heating energies to the different nozzles within each pixel group. The drop volume is a function of the width and amplitude of the heating pulse. The print density can be varied by varying the width or the amplitude of the heating pulse. In the common mode of operation, each row of nozzles is controlled to print the same density level by an identical electric heating pulse.

When the nozzles are essentially the same in different rows, the pulses for different drop volumes can be assigned in any sequence within each pixel group. Randomization (or ordered arrangement) of the pulse assignment to the nozzles within a pixel group can reduce banding caused by variabilities in flight errors between the rows.

According to one preferred embodiment of the present invention, the ink fluid in different nozzles in each row is connected and are set up to the same electric voltage. The ink fluids in different nozzle rows in a print head are separated in different manifolds and electrically insulated. Different voltages $V_1$ for the first row, $V_2$ for the second row, $V_3$ for the third row, etc. are applied to the ink in respective manifolds. A voltage of $V_0$ is applied to the ink receiving media. The electrostatic attractive force between the media and the ink increases with the voltage differences $V_1-V_0$, $V_2-V_0$, $V_3-V_0$, etc. between the media and the ink. The droplet volumes are therefore varied between the nozzle rows.

In this embodiment, the nozzles in the same row are simply connected to the same manifold and the same voltage. The nozzles can be randomized between rows with each pixel groups to reduce systematic printing non-uniformities.

Figure 7:
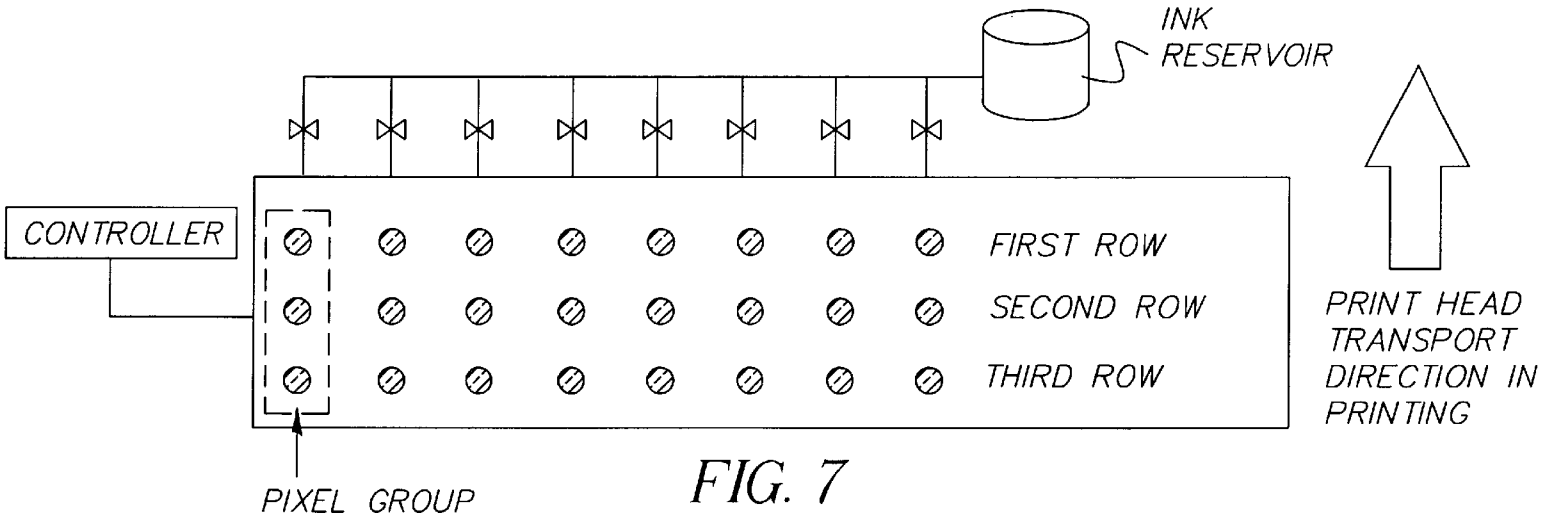
FIG. 7 illustrates another embodiment of the invention.
Figure 8:
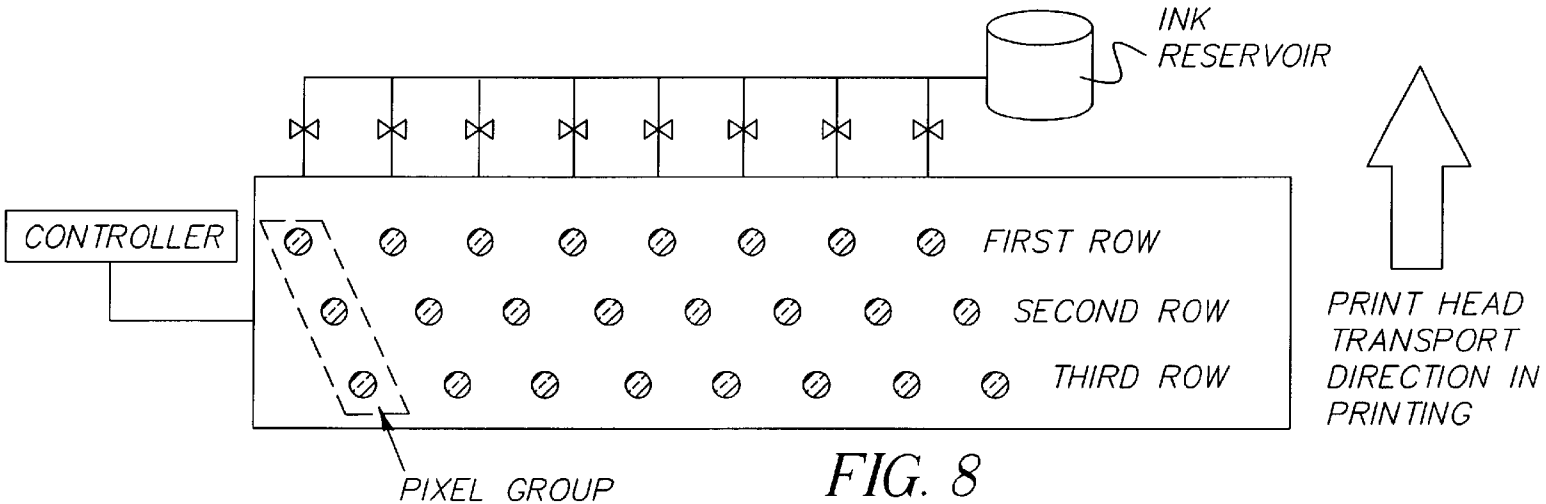
FIG. 8 illustrates yet another embodiment of the invention.
Figure 9:
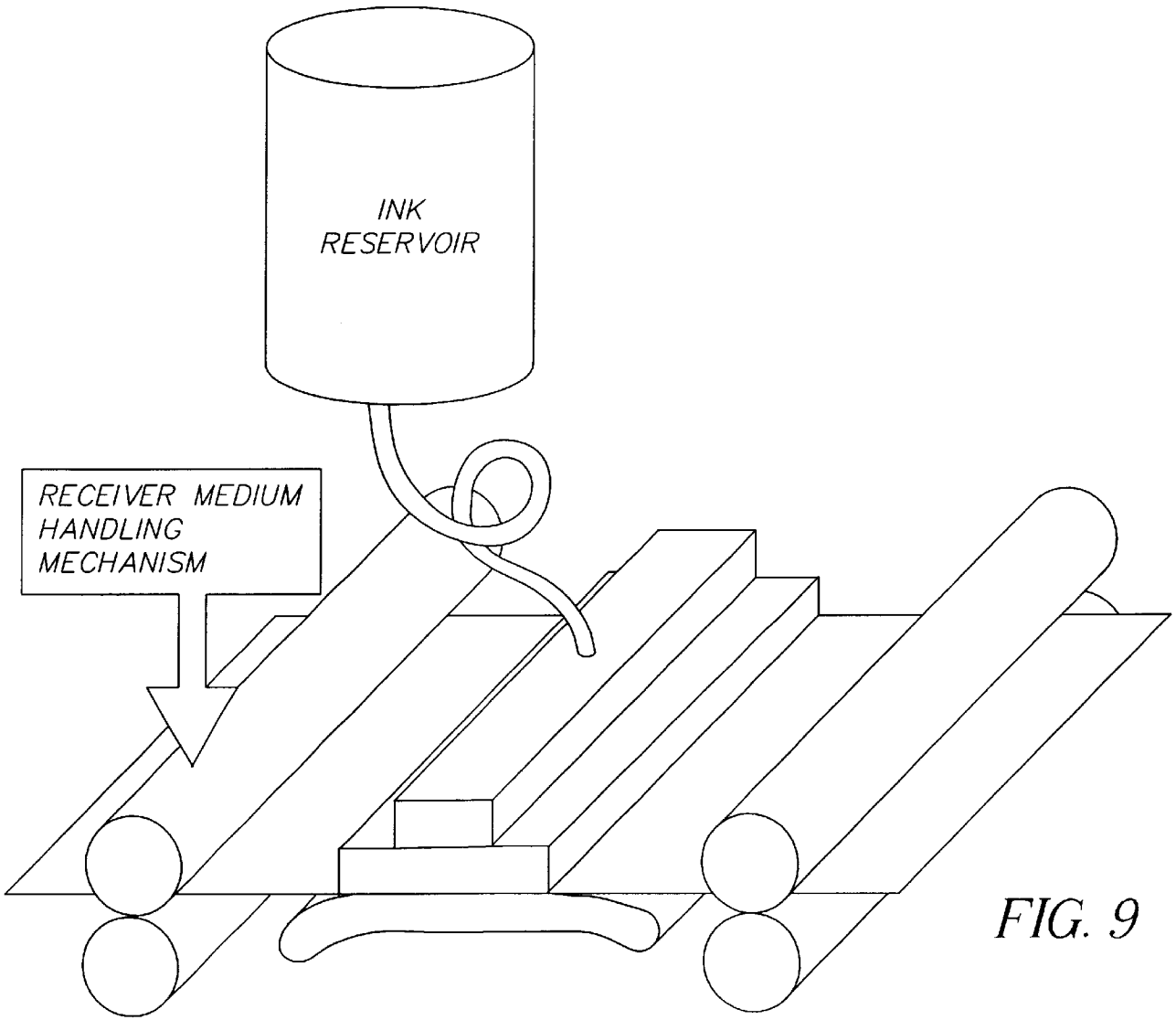
FIG. 9 illustrates a receiver media handling mechanism to advance receiver media past the printing assembly.

According to yet another embodiment, multiple density levels are achieved by applying different ink back pressures to the different nozzles in a pixel group. The nozzles for the same print density and in different pixel groups are connected to the same ink manifold in which a static pressure is applied. In the simplest design, the nozzles in the same row are connected to the same manifold. The nozzles can be randomized between rows with each pixel groups to reduce systematic printing non-uniformities. As shown in FIGS. 7 and 8, there is provided means for applying a different ink pressure to each nozzle of a group. The pressure means may include a pressure regulator interposed between each nozzle group and an ink reservoir.

As best seen in FIG. 7, a receiver handling mechanism is used to advance receiver medium past the printing assembly.

The invention has been described in detail with particular reference to preferred embodiments thereof, but it will be understood that variations and modifications can be effected within the spirit and scope of the invention. It will be clear to persons skilled in the art that variations in other printhead parameters or control parameters in the spirit of this invention can also lead to ink jet printing of multiple density levels. Furthermore, the techniques disclosed in the present invention can be combined with other disclosed techniques such as variation in the nozzle diameter with each pixel group; inks of the same color but different densities can be used in nozzles of the same pixel group; and/or multiple droplets of ink can be ejected from each nozzle of the same pixel group.

What is claimed is:

1. An ink jet printing assembly comprising a plurality of nozzles having a respective ink-ejection opening for ejecting ink therethrough and being arranged to form at least one nozzle group, wherein:

the ink-ejection opening of each of the nozzles that form a nozzle group has a size essentially equal to a corresponding size of the ink-ejection openings of all other nozzles of the group; and each of the nozzles of a group are respectively adapted to produce a different print density when actuated only by a non-constant input signal to heat the ink, the non-constant input signal corresponding to each different print density and having a non-linear decaying portion to avoid boiling of the ink.

2. An ink jet printing assembly as set forth in claim 1, wherein each of the nozzles of a group are respectively adapted to produce a different print density by ejecting a different amount of ink when actuated.

3. An ink jet printing assembly as set forth in claim 1, wherein each of the nozzles of a group are respectively adapted to produce a different print density by ejecting inks of respectively different densities when actuated.

4. An ink jet printing assembly as set forth in claim 1, wherein each of the nozzles of a group are respectively adapted to produce a different print density by ejecting a respectively different number of ink droplets when actuated.

5. An ink jet printing assembly as set forth in claim 1, wherein all of the plurality of nozzles of a group are aligned in a direction to produce pixels at the same location on a receiver that is moving in said direction relative to the printing assembly.

6. An ink jet printing assembly as set forth in claim 1, wherein all of the plurality of nozzles of a group are aligned in a direction to produce pixels at different locations on a receiver that is moving in other than said direction relative to the printing assembly.

7. An ink jet printing assembly as set forth in claim 1, wherein each of the nozzles of a group are respectively adapted to produce a different print density when actuated by substantially identical input signals.

8. An ink jet printing assembly as set forth in claim 1, wherein said nozzles are adapted to eject an amount of ink that is proportional to an amount of electrical energy that is applied thereto; and further comprising means for applying a different electrical energy to each nozzle of a group.

9. An ink jet printing assembly as set forth in claim 8, wherein said means for applying a different electrical energy to each nozzle of a group produces a different electrical voltage for each nozzle of a group.

10. An ink jet printing assembly as set forth in claim 8, wherein said means for applying a different electrical energy to each nozzle of a group produces an electrical pulse of different duration for each nozzle of a group.

11. An ink jet printing assembly as set forth in claim 1, wherein said nozzles are adapted to eject an amount of ink that is proportional to an amount of heat energy that is applied thereto; and further comprising means for applying a different heat energy to each nozzle of a group.

12. An ink jet printing assembly as set forth in claim 11, wherein said means for applying a different heat energy to each nozzle of a group produces a different heat energy amplitude for each nozzle of a group.

13. An ink jet printing assembly as set forth in claim 11, wherein said means for applying a different heat energy to each nozzle of a group produces a different heat energy duration for each nozzle of a group.

14. An ink jet printing assembly as set forth in claim 1, wherein said nozzles are adapted to eject an amount of ink that is proportional to an amount of ink pressure that is applied thereto; and further comprising means for applying a different ink pressure to each nozzle of a group.

15. An ink jet printing assembly as set forth in claim 1, further comprising a resistor associated with each nozzle such that said nozzles are adapted to eject an amount of ink that is proportional to the value of the resistor associated therewith, each resistor of a group being different from each other resistor of that group.

16. An ink jet printing assembly as set forth in claim 1, wherein the different print densities produced by the different nozzles of a group vary sequentially among the nozzles of a group.

17. An ink jet printing assembly as set forth in claim 1, wherein the different print densities produced by the different nozzles of a group vary non-sequentially among the nozzles of a group.

18. An ink jet printer comprising:

a printing assembly as set forth in claim 1;

a receiver media handling mechanism to advance receiver media past the printing assembly;

a controller for producing a series of said input signals.

19. An ink jet printer comprising:

a printing assembly comprising a plurality of nozzles having a respective ink-ejection opening for ejecting ink therethrough and being arranged to form at least one nozzle group, wherein:

the ink-ejection opening of each of the nozzles that form a nozzle group has a size essentially equal to a corresponding size of the ink-ejection openings of all other nozzles of the group, and each of the nozzles of a group are respectively adapted to produce a different print density when actuated only by a non-constant input signal to heat the ink, the non-constant input signal corresponding to each different print density and having a non-linear decaying portion to avoid boiling of the ink;

a body of ink associated with said nozzles;

pressure means for subjecting ink in said body of ink to a pressure of at least 2% above ambient pressure, at least during drop selection and separation;

drop selection means for selecting predetermined nozzles and generating a difference in meniscus position between ink in selected and non-selected nozzles; and drop separating means for causing ink from selected nozzles to separate as drops from the body of ink, while allowing ink to be retained in non-selected nozzles.

20. An ink jet printer comprising:

a printing assembly comprising a plurality of nozzles having a respective ink-ejection opening for ejecting ink therethrough and being arranged to form at least one nozzle group, wherein:

the ink-ejection opening of each of the nozzles that form a nozzle group has a size essentially equal to a corresponding size of the ink-ejection openings of all other nozzles of the group, and each of the nozzles of a group are respectively adapted to produce a different print density when actuated only by a non-constant input signal to heat the ink, the non-constant input signal corresponding to each different print density and having a non-linear decaying portion to avoid boiling of the ink;

a body of ink associated with said nozzles;

drop selection means for selecting predetermined nozzles and generating a difference in meniscus position between ink in selected and non-selected nozzles; and drop separating means for causing ink from selected nozzles to separate as drops from the body of ink, while allowing ink to be retained in non-selected nozzles, said drop selecting means being capable of producing said difference in meniscus position in the absence of said drop separation means.

21. An ink jet printer comprising:

a printing assembly comprising a plurality of nozzles having a respective ink-ejection opening for ejecting ink therethrough and being arranged to form at least one nozzle group, wherein:

the ink-ejection opening of each of the nozzles that form a nozzle group has a size essentially equal to a corresponding size of the ink-ejection openings of all other nozzles of the group, and each of the nozzles of a group are respectively adapted to produce a different print density when actuated only by a non-constant input signal to heat the ink, the non-constant input signal corresponding to each different print density and having a non-linear decaying portion to avoid boiling of the ink;

a body of ink associated with said nozzles, said ink exhibiting a surface tension decrease of at least 10 mN/m over a 30° C. temperature range;

drop selection means for selecting predetermined nozzles and generating a difference in meniscus position between ink in selected and non-selected nozzles; and drop separating means for causing ink from selected nozzles to separate as drops from the body of ink, while allowing ink to be retained in non-selected nozzles.

* * * * *